United States Patent [19]

Davis, Jr. et al.

[11] 4,432,207

[45] Feb. 21, 1984

[54] MODULAR CATALYTIC COMBUSTION BED SUPPORT SYSTEM

[75] Inventors: Lewis B. Davis, Jr., Schenectady; Charles E. Steber, Scotia, both of N.Y.

[73] Assignee: General Electric Company, Schenectady, N.Y.

[21] Appl. No.: 290,696

[22] Filed: Aug. 6, 1981

[51] Int. Cl.[3] ..... F03B 00/00

[52] U.S. Cl. ..... 60/723; 60/753; 60/760

[58] Field of Search ..... 60/723, 758, 753, 760, 60/757, 752, 299, 298, 39.31, 39.32; 431/351, 352, 353, 243; 422/179, 180, 221

[56] References Cited

U.S. PATENT DOCUMENTS

| | | | |
|---|---|---|---|
| 2,458,497 | 1/1949 | Bailey | 60/757 |
| 2,973,624 | 3/1961 | Pierce et al. | 60/757 |
| 3,597,165 | 8/1971 | Keith et al. | 422/179 |
| 3,817,714 | 6/1974 | Wiley | 60/298 |
| 3,967,929 | 7/1976 | Tamazawa et al. | 60/298 |
| 3,972,687 | 8/1976 | Frietzsche | 60/299 |
| 4,040,252 | 8/1977 | Mosier et al. | 60/723 |
| 4,072,007 | 2/1978 | Sanday | 60/723 |
| 4,262,482 | 4/1981 | Roffe et al. | 60/736 |

*Primary Examiner*—Louis J. Casaregola
*Assistant Examiner*—Jeffrey A. Simenauer
*Attorney, Agent, or Firm*—J. C. Squillaro

[57] ABSTRACT

A modular catalytic combustor for a gas turbine has a plurality of individual, non-metallic cylindrical catalyst beds, and a support structure for each of the individual catalyst beds. Each catalyst bed together with its support structure forms an individual catalyst module. Each support structure includes an outer cooled support cylinder, with the individual support cylinders of the various modules interconnected in spaced relationship with cooling air passageways between. There are means for supplying compressed air, such as from a gas turbine compressor, into the space surrounding the support cylinders. The outer cooled support cylinders are provided with apertures for entry of cooling and purge air from the surrounding space. Each of the catalyst beds has an integral, cylindrical, outer ceramic shell, and is positioned within a corresponding outer support cylinder. A sheet metal heat shield is interposed between and concentric with each of the outer support cylinders and the catalyst bed within. The heat shield is mounted and configured so as to provide passageways for cooling and purge air such that a limited amount of cooling and purge air enters through the apertures and flows generally along the outer surface of the heat shield in one axial direction, around an end of the heat shield, and then in the opposite axial direction along the inner surface of the heat shield to exit into the main stream of gas flowing through the combustor. As a result, fuel-air mixture is prevented from entering the annular space just outside the catalyst beds, and cooling of the metal structure is provided without undue cooling of the outer ceramic shell.

14 Claims, 5 Drawing Figures

MODULAR CATALYTIC COMBUSTION BED SUPPORT SYSTEM

BACKGROUND OF THE INVENTION

The present invention relates generally to catalytic combustors for gas turbine power plants and, more particularly, to support structures or holders for catalyst beds, especially modular catalyst beds.

As a means for meeting increasingly strict environmental codes, catalytically-supported thermal combustion systems for gas turbines are being developed. Some catalytic combustors have the potential to provide a low emission, energy-saving, and high combustion-efficiency system. Also, a catalytically-supported thermal combustion system is of relatively small size as compared to an exhaust clean-up system, for example employing catalytic DeNOx in the exhaust. An exhaust clean-up system must process approximately fifteen times the volume of gas compared to a catalytic combustor due to the relatively low pressure and high temperature of the exhaust.

The catalyst bed is preferably a monolithic or unitary structure comprising a carrier of high temperature relatively fragile ceramic material formed into a honeycomb-like structure comprising a multiplicity of thin-walled axially-extending channels. The actual catalytically active material is either carried on the surface of the ceramic substrate, or impregnated therein, and may be a noble metal or a base metal oxide of such elements as zirconium, vanadium, chromium, manganese, copper, platinum, palladium, iridium, rhodium, ruthenium, cerium, cobalt, nickel, iron, and the like.

By way of example, catalytic combustors for gas turbines are disclosed in the Pfefferle U.S. Pat. Nos. 3,928,961 and 4,019,316, and in the DeCorso et al. U.S. Pat. No. 3,943,705. The two Pfefferle patent disclosures in particular discuss the distinction between "catalytically-supported thermal combustion", which involves high temperature and high reaction rate thermal combustion in virtually the entire gas stream within the catalyst bed, and conventional catalytic combustion, which involves reactions taking place at the surface of the catalyst.

Up until the present time, most development work on catalytic combustors for gas turbines has been on bench scale systems with the objective of demonstrating the low emissions characteristics of these combustors with various fuels and over a range of operating conditions. However, few proposals have been directed to the problems of providing long term mechanical integrity of a catalytic combustor, or to the means for starting up and controlling the operation of a complete combustion system over the fuel-air ratio range needed for a practical gas turbine engine. Systems or parts of systems described in the literature either ignore one or more of these problems, or are mechanically very complex due to variable geometry or other such means for limiting the fuel-air ratio entering the catalyst bed.

A system which does address these concerns is disclosed in commonly-assigned U.S. patent application Ser. No. 290,568, filed Aug. 6, 1981, by Davis, Jr. et al. entitled "MODULAR CATALYTIC COMBUSTION BED," now abandoned. That application discloses the overall concept that, as a matter of mechanical integrity, it is highly preferable to separate the catalyst bed into a plurality of individual catalyst modules. As one result, potentially destructive forces resulting from thermal gradients are minimized.

The present invention is directed to more specific aspects of the mechanical design of catalytic combustors, specifically to suitable holders for catalyst beds operating in the environment of a gas turbine combustor. Preferably, as disclosed in the above-identified application Ser. No. 290,568, the catalyst bed is divided into a plurality of modules each comprising a catalyst bed and support structure; in accordance with the present invention, these modules are integrated into a full scale combustor capable of meeting the requirements of a modern gas turbine combustion system. However, the support structure concepts of the present invention need not be limited to modular combustors; they may be applied to combustors having single catalyst beds as well.

A variety of support structures for catalyst beds have been described in the literature. For example, in the literature reference Hung, W. S. Y., Dickson, W. H., DeCorso, S. M., "Preliminary Design Analysis of a Catalytic Ceramic Structure in a Turbine Combustor", *ASME Paper* 78 *WA/GT*-10 (1978), there is disclosed a support structure for a single large catalytic ceramic element, which support structure comprises an air-cooled coiled wire compressed between an outer support cylinder and a layer of castable ceramic on the outer cylindrical surface of the catalyst substrate. Purge and cooling air is metered through apertures in the outer support cylinder into the annular space occupied by the air-cooled coiled wire, and flows upstream to meet and join the main combustor gas flow at the entrance to the catalyst bed. Also, there is an integral cast radially outwardly extending flange at the downstream (hot) end of the catalyst bed, this flange engaging against an element carried by the outer support cylinder.

Another example is disclosed in the literature reference Lew, H. G., Dickson, W. H., DeCorso, S. M., Olson, B. A., Heck, R. M. "Experimentally Determined Catalytic Reactor Behavior and Analysis for Gas Turbine Combustors", *ASME Paper* 79-*GT*-150 (1979). The catalyst bed holder disclosed in this particular literature reference employs a solid (non-porous) outer support cylinder, with thermal insulation of a formed blanket or block type filling an annular cavity defined between the outer shell and the actual catalyst bed. An upstream lip on the catalyst bed bears against a complaint metal element carried by the outer support cylinder, and is held in place by pressure drop across the catalyst bed. Purge and cooling air flow is introduced near the downstream end of the annular insulation space, and travels upstream through the insulation to emerge near the front face of the catalyst bed, and be combined with the main flow of gases through the combustor.

Still another form of holder is disclosed in the following two literature references, although not discussed in great detail: Krill, W. V., Kesselring, J. P., Chu, E. K., "Catalytic Combustion for Gas Turbine Applications", *ASME Paper* 79-*GT*-188 (1979); and Krill, W. V., Kesselring, J. P., Chu, E. K., Kendall, R. M., "Catalytic Combustion for System Applications", *ASME Paper* 79-*HT*-54 (1979). In these literature disclosures, it appears that spoked rings support the catalyst bed at both the upstream and downstream ends, and a large, annular air passageway surrounds the actual catalyst bed. The catalyst bed includes an outer ceramic cylindrical shell.

SUMMARY OF THE INVENTION

It is an object of the present invention to provide suitable holders for ceramic catalyst beds in the environment of a gas turbine combustor employing catalytically-supported thermal combustion, and particularly for a plurality of modular catalyst beds.

It is a further object of the invention to provide an inherently rugged and low stress configuration which is relatively straightforward to manufacture to close tolerances, and relatively easy to analyze during design of specific units of various sizes.

Briefly, and in accordance with one aspect of the invention, a catalytic combustor comprises a catalytically supported thermal combustion zone with means for introducing an air-fuel mixture into the combustion zone. A plurality of individual, non-metallic cylindrical catalyst beds to make up or form the combustion zone, each of the individual catalyst beds having a support structure. Each catalyst bed together with its support structure forms an individual catalyst module.

More particularly, each support structure includes an outer cooled support cylinder, with the individual support cylinders of the various modules interconnected in spaced relationship with air passageways between. There are means for supplying compressed air, such as from a gas turbine compressor, into the space surrounding the support cylinders. The outer cooled support cylinders are provided with apertures for entry of cooling and purge air from the surrounding space. Each of the cylindrical catalyst beds has an integral outer ceramic shell and is positioned within the corresponding outer support cylinder. In accordance with the invention, a sheet metal heat shield is interposed between and concentric with each of the outer support cylinders and the catalyst bed within. The heat shield is mounted and configured so as to provide passageways for cooling and purge air such that a limited amount of cooling and purge air enters through the apertures and flows generally along the outer surface of the heat shield in one axial direction, around an end of the heat shield, and then in the opposite axial direction along the inner surface of the heat shield to exit into the main stream of gas flowing through the combustor. As a result, fuel-air mixture is prevented from entering the annular space just outside the catalyst bed, and cooling of the metal structure is provided without undue cooling of the outer ceramic shell. Preferably, the sheet metal heat shield is secured to the outer support cylinder.

In one more particular embodiment of the invention, the support structure further includes a radially inwardly extending annular projection carried by the downstream end of the support cylinder, with a flanged support ring engaging at its radially outward portion the annular projection, and sealingly engaging on its radially inward portion the downstream end of the ceramic shell of the catalyst bed. The flanged support ring is configured so as to restrain the catalyst bed against axial movement in the downstream direction. In this particular embodiment, the heat shield is configured at its upstream end for retaining engagement with the upstream end of the ceramic shell and for securing to the support structure. The heat shield is configured at its downstream end so as to bear radially against the outer support cylinder. A plurality of retainer springs are interposed between the heat shield and the ceramic shell for support of the catalyst bed, while permitting thermal expansion.

In another more particular embodiment of the invention, the ceramic shell integral with the catalyst bed includes an annular ceramic support flange extending radially outward near the upstream end of the catalyst bed. The support flange has a pair of oppositely facing axially directed engagement faces inclined towards each other. Additionally, a face seal flange is carried by the outer support cylinder near the upstream end thereof, and the face seal flange has an angled face seal surface configured for mating engagement with the downstream directed engagement face of the ceramic support flange. Finally, an element carried by the outer support cylinder resiliently bears against the upstream directed engagement face of the ceramic support flange. This element may take the form of an expanding ring radially outwardly engaging an inclined flange on the outer support cylinder, or it may comprise a ring loaded against the upstream directed engagement face by a plurality of axial loading springs.

As a result, in this configuration, the ceramic support flange, the face seal flange, and the element carried by the outer support cylinder provide both centering and axial support for the catalyst bed. The sheet metal heat shield is simply secured at its downstream end to the outer support cylinder.

In accordance with other aspects of the invention, similar support systems are provided for unitary (non-modular) catalyst beds in catalytic combustors.

BRIEF DESCRIPTION OF THE DRAWINGS

While the novel features of the invention are set forth with particularity in the appended claims, the invention, both as to organization and content, will be better understood and appreciated, along the other objects and features thereof, from the following detailed description taken in conjunction with the drawings, in which:

DESCRIPTION OF THE PREFERRED EMBODIMENTS

Figure 1:
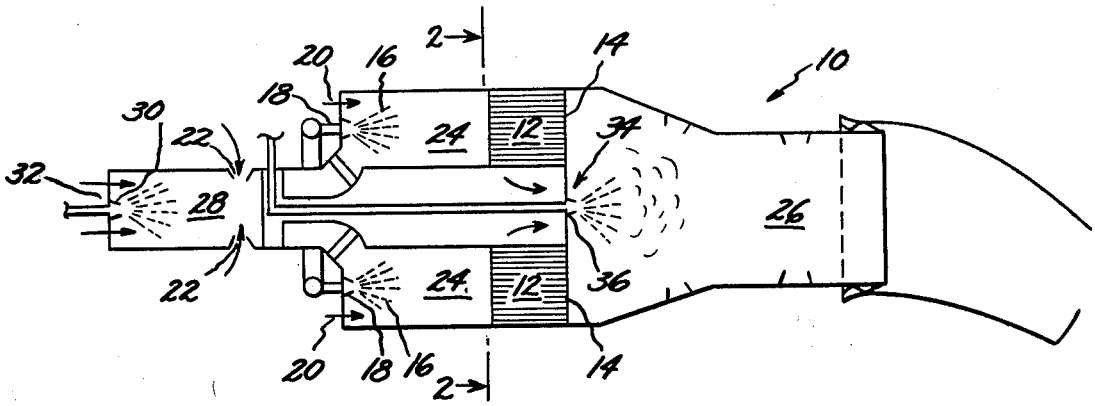
FIG. 1 shows an overall view of a staged hybrid modular catalytic combustor forming the environment for the catalyst bed holder structure of the present invention.

Referring first to FIG. 1, a staged modular catalytic combustor generally designated 10 includes a modular catalyst bed 14 in a catalytically-supported thermal combustion zone 12. A plurality of fuel sprays 16 supplied from main fuel nozzles 18, together with main combustion air inlets 20 and 22, introduce a fuel-air mixture into the catalytically-supported thermal combustion zone 12 through a fuel preparation (mixing and vaporizing) region 24 of no flame.

In conventional fashion, the combustor 10 discharge duct 26 supplies hot, expanded gases at a temperature in the order of 2100° F. to drive a gas turbine (not shown), thereby to provide useful power output. Driven by the gas turbine, often on the same shaft, is an air compressor (also not shown), which, from its discharge, provides combustion and cooling air for the combustor 10, For example, it is compressor discharge air which is introduced into the main combustion air inlets 20 and 22.

For start up preheating, an upstream pilot flame may be established in a pilot combustor 28 supplied by a fuel nozzle 30 and an air inlet 32. For additional combustion control, a secondary burner 34 is provided downstream of the catalyst bed 14, and supplied with fuel through an opening 36 centrally located with respect to the actual individual catalyst modules. Details of a suitable downstream combustor are disclosed in commonly-assigned application Ser. No. 290,567, filed Aug. 6, 1981, by Hilt et al., entitled "CATALYTIC COMBUSTION SYSTEM PILOT BURNER".

The pilot combustor 28 is of conventional design for machine start up, catalyst preheat, and control of the premixed/prevaporized fuel-air mixture temperature during operation. The auxiliary or secondary burner 34 serves to extend the overall fuel-air ratio range of the combustor 10.

Figure 2:
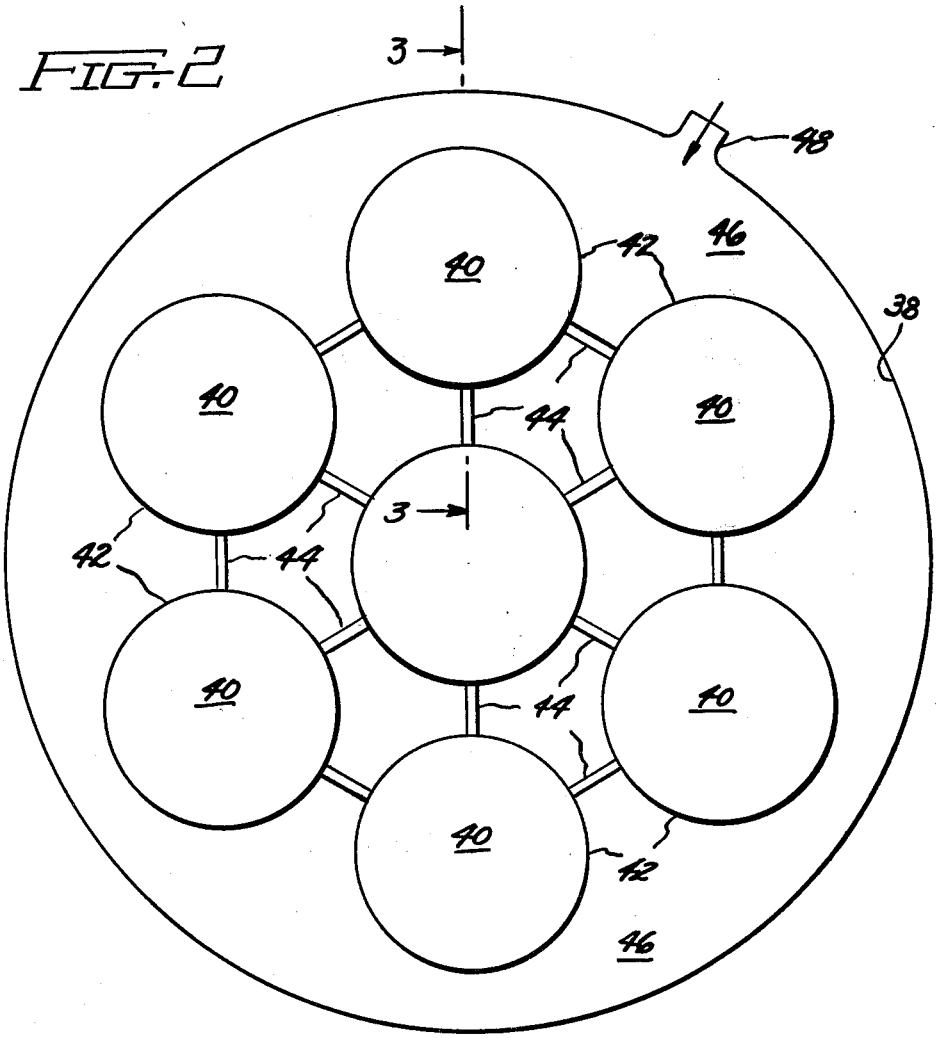
FIG. 2 is a longitudinal cross sectional view taken along line 2—2 of FIG. 1 depicting locations of individual catalyst modules.

With reference now to FIG. 2, the arrangement of the individual catalyst modules of FIG. 1 is depicted. In FIG. 2, the liner wall of the overall combustor 10 is designated 38, and individual cooled support cylinders for individual catalyst beds 40 are designated 42. More particularly, the outer support cylinders 42 are interconnected in spaced relationship by means of representative supports designated 44, and cooling and purge air is introduced into the surrounding space 46 through a representative opening 48. This cooling and purge air introduced through the opening 48 is supplied in conventional fashion from the gas turbine compressor (not shown).

Figure 3:
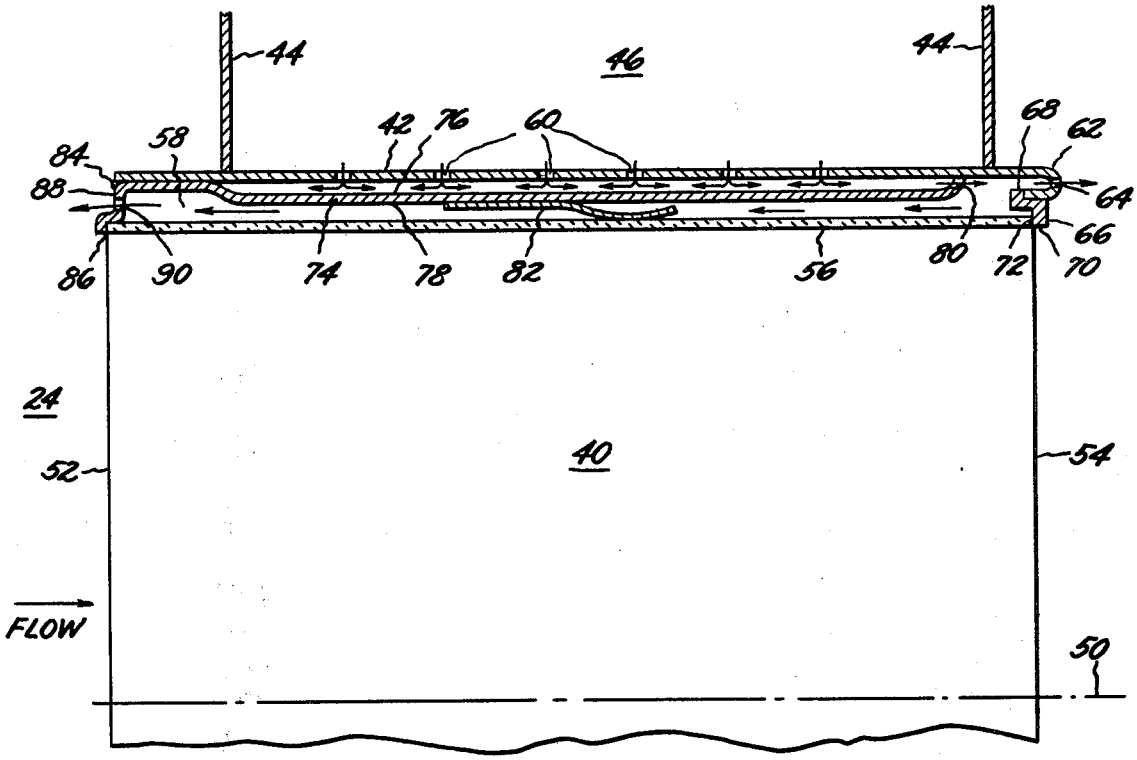
FIG. 3 is a cross sectional view taken along line 3—3 of FIG. 2 showing one form of catalyst bed and immediate support structure.

With reference now to FIG. 3, there is shown one specific form of support structure in accordance with the invention. FIG. 3 is a lateral sectional view of one module about a module center line 50. In FIG. 3 may be seen one of the outer support cylinders 42 of FIG. 2, as well as interconnecting, cooled supports 44.

The FIG. 3 catalyst bed 40 has an upstream end 52 supplied with premixed and prevaporized fuel from the fuel preparation region 24 (FIG. 1), and a dowstream end 54 supplying the FIG. 1 discharge duct 26.

In FIG. 3, the catalyst bed 40 has an integrally formed constant thickness, ceramic shell 56 of cylindrical configuration. The ceramic shell 56 is positioned concentric with the corresponding outer support cylinder 42, defining an annular space 58 therebetween.

To permit cooling and purge air to enter the annular space 58 from the surrounding space 46, the cooled support cylinder 42 is provided with a plurality of apertures 60. For proper operation of the combustor, it is important to prevent any fuel-air mixture from entering the annular space 58 between the catalyst bed 40 and the cooled support cylinder 42, which would otherwise lead to premature failure of the combustor due to burning as it passed over the hot ceramic shell 56. It is also important to control and limit the flow of cooling and purge air in the annular space 58 so as to prevent undue cooling of the ceramic shell 56, and to prevent excessive amounts of air from flowing out into the fuel preparation region 24 (FIG. 1) and upsetting the distribution of fuel and air ahead of the catalyst bed. Accordingly, the dimensions of the entire structure, including the sizing and number of the apertures 60, is designed for proper cooling, bleed and purge air flow.

In the FIG. 3 embodiment, the downstream end of the cooled support cylinder 42 has a radially inwardly extending annular projection 62 in the form of an inward roll, with spaced apertures 64 for exiting of some bleed air from the annular space 58. A flanged support ring 66 made of a high temperature, low coefficient of expansion material such as silicon-silicon carbide, has a radially outward portion 68 engaging the annular projection 64, and has a radially inward portion 70 sealingly engaging a surface 72 on the downstream end of the ceramic shell 56. The flanged support ring 66 is configured so as to restrain the catalyst bed 40 against axial movement towards the downstream direction. In order to minimize thermal gradients in the ceramic shell 56, the support ring 66 operates near the discharge temperature of the catalyst bed 40. The mating surfaces 70 and 72 of the support ring 66 and ceramic shell 56 are made as flat as possible to minimize leakage of purge air.

An important aspect of the present invention is the provision of a sheet metal heat shield 74 of tubular configuration within the annular space 58 interposed in spaced relationship between the cooled support cylinder 42 and the catalyst bed 40. In general, the heat shield 74 is mounted and configured so as to provide passageways for cooling and purge air such that an appropriately limited amount of cooling and purge air entering through the apertures 60 flows generally along the outer surface 76 of the heat shield 74 in one axial direction (the downstream direction in FIG. 3), around an end of the heat shield 74, and then in the opposite axial direction along the inner surface 78 of the heat shield 74 to ultimately exit into the main stream of gas flowing through the combustor. As a result, fuel-air mixture is prevented from entering the annular space 58 on the outside of the catalyst bed 40, and cooling of the various metal structure elements is provided without undue cooling of the ceramic shell 56.

In a specific embodiment of FIG. 3, flow of air around an end of the heat shield 74 is through apertures 80 provided for this purpose, between which apertures 80 the heat shield end bears against the support cylinder 42.

Additionally shown in FIG. 3 is one of a plurality of spaced support springs 82 which serve to center the catalyst bed 40, while allowing independent thermal growth of the ceramic catalyst 40 and the sheet metal heat shield 74. The retainer springs 82 are fastened to the heat shield 74, forming an assembly therewith.

The arrangement of FIG. 3 facilitates assembly of the complete module, in particular, insertion of the catalyst bed 40 into the cooled support cylinder 42. For assembly, the support ring 66, catalyst bed 40 with integral ceramic shell 56, and the heat shield 74 and support spring 82 assembly are inserted into the cooled support cylinder 42 from the upstream end 52. Next, the upstream end of the heat shield 74 is secured to the cooled support cylinder 42 by means of tack welds, as at 84. As may be seen in FIG. 3, the heat shield 74 is configured at its upstream end for retaining engagement at 86 with the upstream end of the ceramic shell 56, with an inturned portion 88 extending between the tack welds 84 and the engagement at 86. The inturned portion 88 is slotted as at 90 to bleed an appropriately limited amount of cooling and purge air.

An advantage of the FIG. 3 embodiment compared to hereafter described embodiments is that the ceramic shell 56 of the catalyst bed 40 may be constant thickness, i.e., without having any integral flanges or other mounting structure.

Figure 4:
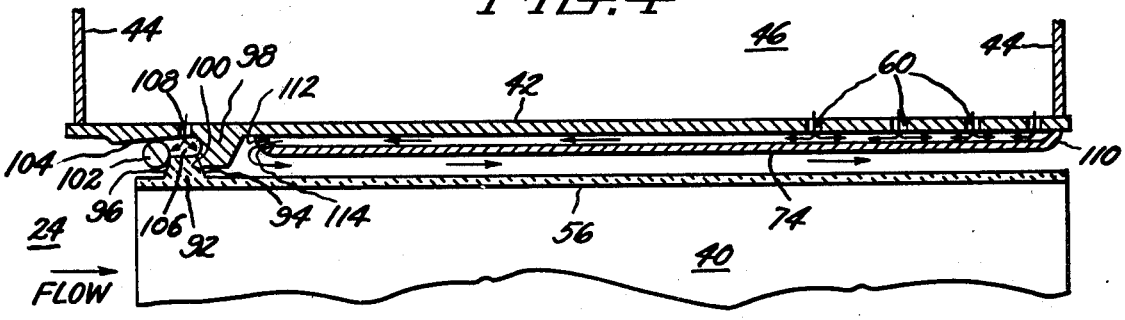
FIG. 4 is a view similar to FIG. 3 showing another form of catalyst bed and support structure.

With reference now to FIG. 4, an alternative embodiment is illustrated for use where the outer ceramic shell 56 is provided with an integral ceramic annular support flange 92 extending radially outward near the upstream end 52 of the catalyst bed 40. More particularly, the ceramic support flange 92 has a pair of oppositely-facing axially-directed engagement faces 94 and 96 inclined towards each other. A face seal flange 98 is carried by the outer support cylinder 42 near the upstream end thereof, and has an angled face seal surface 100 configured to sealingly abut the downstream directed engagement face 94 of the ceramic support flange 92. An element, shown in FIG. 4 as an expanding ring 102 radially outwardly engaging an inclined annular flange 104 on the cooler support cylinder 42, resiliently bears against the upstream directed engagement face 96 of the ceramic support flange 92. To prevent any air-fuel mixture from entering the space 106 between the face seal flange 98 and the expanding ring 102, an aperture 108 is provided through which seal purge air enters.

As a result of this construction, the ceramic support flange 92, the face seal flange 98, and the expanding ring 102 provide both centering and axial support for the catalyst bed 40. Accordingly, no other support structure whatsoever is needed for the catalyst bed 40. In particular, it is totally unsupported at its downstream (hot) end 54.

In the FIG. 4 embodiment, the sheet metal heat shield 74 is secured at least at its downstream end 110 to the outer support cylinder 42, and the apertures 60 in the outer support cylinder 42 for entry of cooling and purge air are provided primarily at the downstream end 54.

At its downstream end 110 the heat shield 74 is mounted to the outer support cylinder 42, and at the upstream end 112 apertures 114 are provided so that cooling and purge air can effectively pass around the end 112 of the heat shield 74, and turn in the opposite direction to emerge downstream of the catalyst bed 40.

As already mentioned, a significant feature of the embodiment of FIG. 4 is the avoiding of contact with the ceramic shell 46 at the downstream (hot) end 54 altogether. Since the metal and the ceramic at the forward end of the catalyst bed 40 are both at the temperature of the entering fuel-air mixture, thermal stresses in either the metal face seal flange 98 and the integral ceramic flange 92 due to local temperature gradients are minimal. However, there are radial growth differences between the metal and the ceramic due to the different expansion coefficients, and these are accommodated by means of the angled face seal 98 and the expanding ring 102 in combination with the angled faces 94 and 96.

Figure 5:
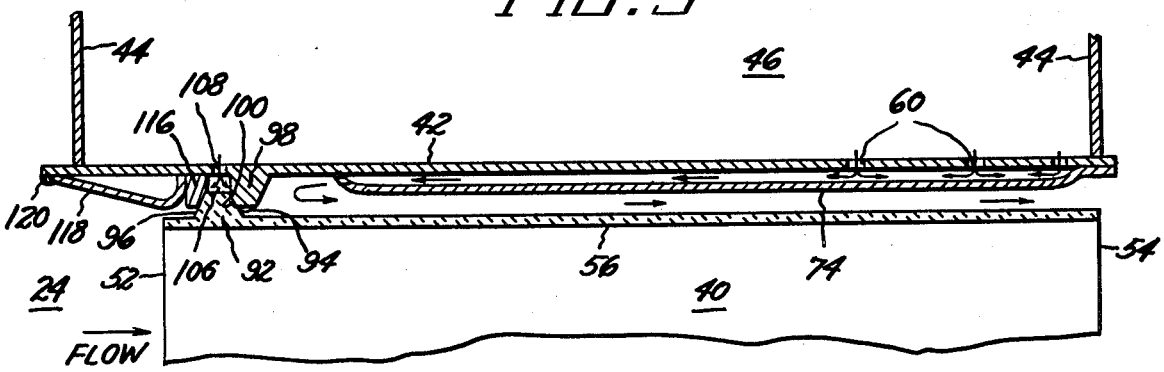
FIG. 5 shows a slight modification of the FIG. 4 embodiment.

FIG. 5 depicts still another embodiment, quite similar to that of FIG. 4, but more tolerant to dimensional stack-up. In particular, FIG. 5 omits the expanding ring 102 and inclined annular flange 104 of FIG. 4, and instead has a ring 116, comparable to a piston ring, loaded against the upstream directed engagement face 96 of the flange 92 by a plurality of axial loaded springs 118 secured to the outer support cylinder 42 by welding as at 120.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A support structure for a cylindrical ceramic catalyst bed for use with a gas turbine combustor, comprising:

an outer cooled support cylinder;

said outer cooled support cylinder including apertures therethrough effective for permitting entry of compressed air from a surrounding space;

a cylindrical outer ceramic shell concentric within said outer support cylinder and spaced therefrom to form an annular space therebetween;

a sheet meal heat shield in said annular space interposed between and concentric with said outer cooled support cylinder and said cylindrical outer ceramic shell, said heat shield being effective to form a first passageway for permitting air entering through said apertures to flow generally along an outer surface of said heat shield in a first axial direction, apertures for permitting said air to flow around an end of said heat shield, and a second passageway for permitting said air to flow in a second opposite axial direction along an inner surface of said heat shield and apertures to permit said air to exit into a main stream of gas flowing through said combustor, whereby entry of a fuel-air mixture into said annular space is prevented and said support cylinder and said heat shield are cooled without unduly cooling said outer ceramic shell.

2. A support structure according to claim 1, including means for securing said sheet metal heat shield to said outer support cylinder.

3. A support structure according to claim 1, further including:

a radially inwardly extending annular projection on a downstream end of said cooled support cylinder;

a support ring including a radially outward portion and a radially inward portion, said radially outward portion including means for engaging said annular projection and said radially inward portion including means for sealingly engaging a downstream end of said ceramic shell, said support ring including means for retaining said ceramic shell against axial movement in the downstream direction;

said heat shield including means at its upstream end for retaining engagement with an upstream end of said ceramic shell and said cooled support cylinder, and said heat shield further including means at its downstream end for bearing radially against said cooled support cylinder; and resilient means between said heat shield and said ceramic shell for supporting said ceramic shell while permitting thermal expansion thereof.

4. A support structure according to claim 1, further including:

an integral ceramic annular support flange on said ceramic shell extending radially outward near an upstream end of said ceramic shell, said ceramic annular support flange including an upstream directed engagement face and a downstream directed engagement face, said upstream and downstream directed engagement faces being inclined toward each other;

a face seal flange on said outer support cylinder near an upstream end thereof, said face seal flange having an angled face seal surface effective to provide mating engagement with said downstream directed engagement face; and means on said cooled support cylinder for resiliently bearing against said upstream directed engagement face whereby said ceramic annular support flange, said face seal flange, and said means on said cooled support cylinder provide both centering and axial support for said catalyst bed.

5. A support structure according to claim 4, wherein said annular heat shield includes a sheet metal shield and means for securing said sheet metal heat shield at its downstream end to said cooled outer cylinder.

6. A support structure according to claim 4, wherein said means on said cooled support cylinder includes an annular flange on said outer support cylinder and an expanding ring biased radially outwardly engaging said inclined annular flange.

7. A support structure according to claim 4, wherein said means on said cooled support cylinder includes a ring abutting said upstream directed engagement face and a plurality of axial loading springs urging said ring into abutment with said upstream directed engagement face.

8. A catalyst bed for a catalytic combustor comprising:

a cylindrical ceramic shell;

a cooled support cylinder surrounding said cylindrical ceramic shell and spaced outward therefrom to form an annular space therebetween;

means for supporting said cylindrical ceramic shell within said cooled support cylinder;

an annular heat shield in said annular space effective to divide said annular space into an outer annular portion and an inner annular portion substantially sealed from each other;

means for supplying a supply of compressed air to an outside of said cooled support cylinder;

a plurality of apertures in said cooled support cylinder effective for admitting said compressed air therethrough into said outer annular portion;

means for permitting said compressed air to flow in a first axial direction within said outer annular portion and for substantially blocking it from flowing in a second axial direction therein whereby an outer surface of said annular heat shield is cooled and said compressed air is heated;

at least one aperture in an extremity of said annular heat shield in said first axial direction effective to permit said compressed air to flow therethrough from said outer annular portion to said inner annular portion between said annular heat shield and said cylindrical ceramic shell;

means for permitting at least a substantial portion of said compressed air to flow in said second axial direction opposite to said first axial direction in said inner portion; and means for venting said compressed air at an extremity in said second axial direction of said inner annular portion whereby said compressed air travels in said first axial direction in contact with an outer surface of said annular heat shield and then oppositely in said second axial direction in contact with an inner surface of said heat shield before venting from said annular space.

9. A catalytic bed according to claim 8, wherein said annular heat shield includes a sheet metal heat shield and means for securing said sheet metal heat shield to said cooled outer support cylinder.

10. A catalytic bed according to claim 8, wherein said means for supporting said cylindrical ceramic shell includes:

a radially inwardly extending annular projection on a downstream end of said cooled support cylinder;

a support ring including a radially outward portion and a radially inward portion, said radially outward portion including means for engaging said annular projection and said radially inward portion including means for sealingly engaging a downstream end of said ceramic shell, said support ring including means for restraining said ceramic shell against axial movement in the downstream direction;

said annular heat shield including means at its upstream end for retaining engagement with an upstream end of said ceramic shell and said cooled support cylinder, and said heat shield further including means at its downstream end for bearing radially against said cooled support cylinder; and resilient means between said heat shield and said ceramic shell for supporting said ceramic shell while permitting thermal expansion thereof.

11. A catalytic bed according to claim 8, wherein said means for supporting further includes:

an integral ceramic annular support flange on said ceramic shell extending radially outward near an upstream end of said ceramic shell, said ceramic annular support flange including an upstream directed engagement face and a downstream directed engagement face, said upstream and downstream directed engagement faces being inclined toward each other;

a face seal flange on said outer support cylinder near an upstream end thereof, said face seal flange having an angled face seal surface effective to provide mating engagement with said downstream directed engagement face; and means on said cooled support cylinder for resiliently bearing against said upstream directed engagement face whereby said ceramic annular support flange, said face seal flange, and said means on said cooled support cylinder provide both centering and axial support for said catalyst bed.

12. A catalytic bed according to claim 11, wherein said annular heat shield includes a sheet metal heat shield and means for securing said sheet metal heat shield at its downstream end to said cooled outer cylinder.

13. A catalytic bed according to claim 11, wherein said means on said cooled support cylinder includes an annular flange on said outer support cylinder and an expanding ring biased radially outwardly engaging said inclined annular flange.

14. A catalytic bed according to claim 11, wherein said means on said cooled support cylinder includes a ring abutting said upstream directed engagement face and a plurality of axial loading springs urging said ring into abutment with said upstream directed engagement face.

* * * * *